US005501387A

United States Patent [19]

Yoshie

[11] Patent Number: 5,501,387

[45] Date of Patent: Mar. 26, 1996

[54] STAPLE CARTRIDGE AND STAPLE SHEET PACK

[75] Inventor: Toru Yoshie, Tokyo, Japan

[73] Assignee: Max Co., Ltd., Tokyo, Japan

[21] Appl. No.: 181,032

[22] Filed: Jan. 14, 1994

[30] Foreign Application Priority Data

| | | | |
|---|---|---|---|
| Jan. 18, 1993 | [JP] | Japan | 5-006234 |
| Jan. 19, 1993 | [JP] | Japan | 5-007002 |
| Jan. 21, 1993 | [JP] | Japan | 5-008633 |

[51] Int. Cl.[6] ..... B27F 7/17; B27F 7/38

[52] U.S. Cl. ..... 227/120; 227/136; 227/82; 206/340

[58] Field of Search ..... 227/120, 131, 227/82, 85, 135, 136; 53/399, 412; 206/338, 340, 343, 83.5, 442

[56] References Cited

U.S. PATENT DOCUMENTS

| | | | |
|---|---|---|---|
| 2,943,436 | 7/1960 | Peterssen | 59/77 |
| 2,991,477 | 7/1961 | Hoyle et al. . | |
| 3,987,901 | 10/1976 | Dullinger | 206/451 |
| 4,623,082 | 11/1986 | Kurosawa | 227/7 |
| 4,993,616 | 2/1991 | Yoshie et al. | 227/120 |
| 5,269,451 | 12/1993 | Udagawa et al. | 227/120 |
| 5,346,114 | 9/1994 | Udagawa et al. | 227/120 |

FOREIGN PATENT DOCUMENTS

| | | | |
|---|---|---|---|
| 186914 | 7/1986 | European Pat. Off. . | |
| 366094 | 5/1990 | European Pat. Off. . | |
| 475436 | 3/1992 | European Pat. Off. . | |
| 241912 | 8/1944 | France . | |
| 2242203 | 9/1973 | France . | |
| 64298 | 1/1989 | Japan . | |
| 184985 | 6/1989 | Japan . | |
| 1101782 | 7/1989 | Japan . | |
| 4-304977 | 10/1992 | Japan | 227/136 |
| 9002635 | 3/1990 | WIPO . | |

*Primary Examiner*—Richard K. Seidel
*Assistant Examiner*—Jay A. Stelacone
*Attorney, Agent, or Firm*—Cushman Darby & Cushman

[57] ABSTRACT

An object of the present invention is to provide a staple cartridge usable for a motor driven stapler wherein the staple cartridge can repeatedly be used to substantially reduce the quantity of disposable waste material, thereby saving a useful resource. The bottom surface of a staple cartridge 11 is open so as to allow the staple cartridge 11 to be detachably charged in a staple sheet holder 13. A predetermined number of staple sheets 2 are received in the staple sheet holder 13 in the laminated state and in the form of a staple sheet pack 12 bounded by a band 14. Engagement holes 23 are formed on the staple sheet holder 13. As the staple sheet pack 12 is inserted into the staple cartridge 11 through an open portion on the bottom surface of the staple cartridge 11, the engagement pawls 24*a* of a lock lever 24 are brought in engagement with the engagement holes 23 so as to lock the staple sheet pack 12 to be firmly held in the staple cartridge 11. After the band 14 is disconnected from the staple pack 12, the staple cartridge 11 is fitted to a motor driven stapler. Each empty staple sheet pack 12 can be exchanged with a new one by actuating the lock lever 24.

13 Claims, 12 Drawing Sheets

202
212
213
213a 226
229
221
224
216
211c
215
212
213
213a
202
225
227
219
223
211b 229
221
226
224
202
223
225
227
219
211b
211c
216
215

STAPLE CARTRIDGE AND STAPLE SHEET PACK

BACKGROUND OF THE INVENTION

The present invention relates to a staple cartridge employable for a motor driven stapler for stapling a plurality of printed papers or the like. The present invention also relates to a staple sheet pack utilized for the staple cartridge.

Various kinds of motor driven staplers each having a motor or a solenoid are commercially utilized. Usually, substantially inverted U-shaped staples are used by motor driven staplers. Alternatively, a staple sheet 2 having a plurality of straight staples 1 successively connected to each other in a side-by-side relationship as shown in FIG. 16 is used by the motor driven stapler. As shown in FIG. 17, a plurality of staple sheets 2 in the laminated state are received in a staple cartridge 3, which is molded of a transparent synthetic resin. The staple sheets 2 are normally biased in the downward direction by a compression coil spring 4, which applies a resilient force to a press plate 5. The staple sheets 2 are supported by base plates 6, which are angularly positioned adjacent to the lower edges of the sides of the staple cartridge 3, as shown in FIG. 18.

As shown in FIG. 19, the staple cartridge 3 is charged in a motor driven stapler 7. As a motor (not shown) is rotationally driven, a plurality of staple sheets in the laminated state, which is received in the staple cartridge 3, are successively and forwardly (i.e., in the leftward direction as viewed in FIG. 19) conveyed one-by-one along the lower surface of a guide portion 9 disposed at the front end of the staple cartridge 3 with the aid of a timing belt 8 or rollers (not shown). As a forming mechanism (not shown) is actuated, a staple located at the front end of the staple sheet is deformed to exhibit a substantially inverted U-shaped contour. Thereafter, it is driven toward the clincher 10 by a driver (not shown) of the forming mechanism so as to staple a plurality of recorded papers together.

Compared with the case in which a series of preliminarily deformed staples each having a substantially inverted U-shaped contour are used, the motor driven stapler having a staple cartridge containing a plurality of staple sheets in the laminated state does not necessitate supplementation of staples as frequently, since a larger number of staples can be received in the staple cartridge. Thus, the stapling operation can be achieved at a higher efficiency.

However, after consumption of all the laminated staple sheets received in the staple cartridge, the empty staple cartridge should be exchanged with a new one. In practice, it is difficult to treat the used staple cartridge, which is molded of a synthetic resin, as a waste material by burning it. Moreover, such disposal of the cartridge can inflict harmful effects upon the environment.

On the other hand, a recycling operation for used staple cartridges is ineffective and economically undesirable. Recycling would require a separating operation to be performed for separating components molded of a synthetic resin from components made of a metallic material.

The present invention has been made in consideration of the aforementioned problems associated with the prior art. Accordingly, an objective of the present invention resides in providing a staple cartridge which can be repeatedly reused without encountering any of the particular problems associated with disposable treatment of each used staple cartridge.

SUMMARY OF THE INVENTION

A staple cartridge employable for a motor driven stapler according to a first aspect of the present invention comprises a receiving member for receiving a plurality of staple sheets in the laminated state, each of the staple sheet including a plurality of straight staples successively connected in a side-by-side relationship. The laminated structure of the staple sheets is bundled by a band member. The staple cartridge is detached from the motor driven stapler when the bundled staple sheets are inserted into the receiving member.

According to a second aspect of the present invention, there is provided a staple cartridge employable for a motor driven stapler wherein a plurality of staple sheets each including a plurality of straight staples successively connected in a side-by-side relationship are received in the staple cartridge. The staple cartridge is characterized in that a staple holder having the staple sheets received therein in the laminated state is constructed in such a manner as to be detachably fitted into the staple cartridge.

In addition, according to a third aspect of the present invention, there is provided a staple sheet pack usable for the staple cartridge constructed according to the preceding aspect of the present invention, wherein the staple sheet pack is made of a material such as a paper, a synthetic resin, or the like, each of which can be disposably treated as a burnable waste material. A plurality of laminated staple sheets are received in the staple sheet holder. The staple sheets and the staple sheet holder are bundled together using a band.

With the staple cartridge according to the third aspect of the present invention, the staple sheet pack composed of a staple sheet holder and a plurality of staple sheets is detachably fitted into the staple cartridge. Thus, the staple cartridge itself can repeatedly be used by exchanging each empty staple sheet pack with a new one.

The staple sheet pack according to the third aspect of the present invention is constructed such that a predetermined number of staple sheets are received in the staple sheet holder, which is capable of being disposably treated as a burnable waste. The staples are bundled together using tape. Thus, when the bundled structure is disassembled by disconnecting or breaking the tape after the staple sheet pack is charged in the staple cartridge, the staple supplementing operation is complete. The empty staple sheet holder is thrown away as a burnable waste.

According to a fourth aspect of the present invention, there is provided a staple cartridge employable for a motor driven stapler wherein a plurality of staple sheets each having a plurality of straight staples successively connected in a side-by-side relationship are received in the staple cartridge in the laminated state. The staple cartridge is substantially composed of a cartridge and a staple sheet holder inserted into the staple cartridge. The staple sheet holder is constructed such that it can be introduced into a withdrawn from the staple cartridge. The staple sheets can be charged in the staple sheet holder.

With the staple cartridge according to the fourth aspect of the present invention, the staple sheet holder received in the staple cartridge is withdrawn therefrom so as to allow it to be exposed. After completion of the withdrawing operation, a predetermined number of staple sheets in the laminated state are received in the staple sheet holder. Thereafter, the staple sheet holder having the staple sheets received therein is inserted into the staple cartridge. In such manner, the staple cartridge can be repeatedly reused.

In addition, according to fifth aspect of the present invention, there is provided a staple sheet pack for a staple cartridge. The staple sheet pack is characterized in that a predetermined number of staple sheets capable of being received in the staple sheet holder are laminated one above another in the staple sheet holder. The laminated staple sheets are bundled using a band. The staple sheet pack is charged into the staple sheet holder. Consequently, when the staple sheet pack is released from the bundled state, a predetermined number of staple sheets are supplemented in the staple sheet holder.

The present invention according to a sixth aspect provides a staple cartridge employable for a motor driven stapler wherein a plurality of staple sheets each having a plurality of straight staples successively connected to each in a side-by-side relationship are received in a cartridge in the laminated state. The staple sheets are supported on bottom plates disposed on the opposite sides of an open portion of the bottom surface of the cartridge. The staple cartridge includes an opening/closing mechanism for opening or closing the bottom plates so that the staple sheets are charged in the staple cartridge through the open portion of the bottom surface thereof.

With the staple cartridge according to the sixth aspect of the present invention, the bottom surface of the staple cartridge is open with the exception of the bottom plates for supporting the opposite side edges of the staple sheets. A staple sheet conveying belt of the motor driven stapler or the like is brought in contact with the lower surface of the bottom staple sheet so as to forwardly and successively convey a plurality of staple sheets laminated one above another in the staple cartridge. To assure that the bottom surface of the staple cartridge remains open during the charging and withdrawing operations, the bottom plates are turnably or slidably secured to a housing of the staple cartridge so that they are turned or slidably displaced toward the outside. After a plurality of staple sheets are inserted into the staple cartridge having an opened bottom surface, the bottom plates are restored to their original positions and the staple sheet supplementing operation is complete. With such construction, the staple cartridge can be repeatedly reused.

DETAILED DESCRIPTION OF THE PREFERRED EMBODIMENTS

The present invention will now be described in detail hereinafter with reference to the accompanying drawings which illustrate a few preferred embodiments thereof.

Figure 1:
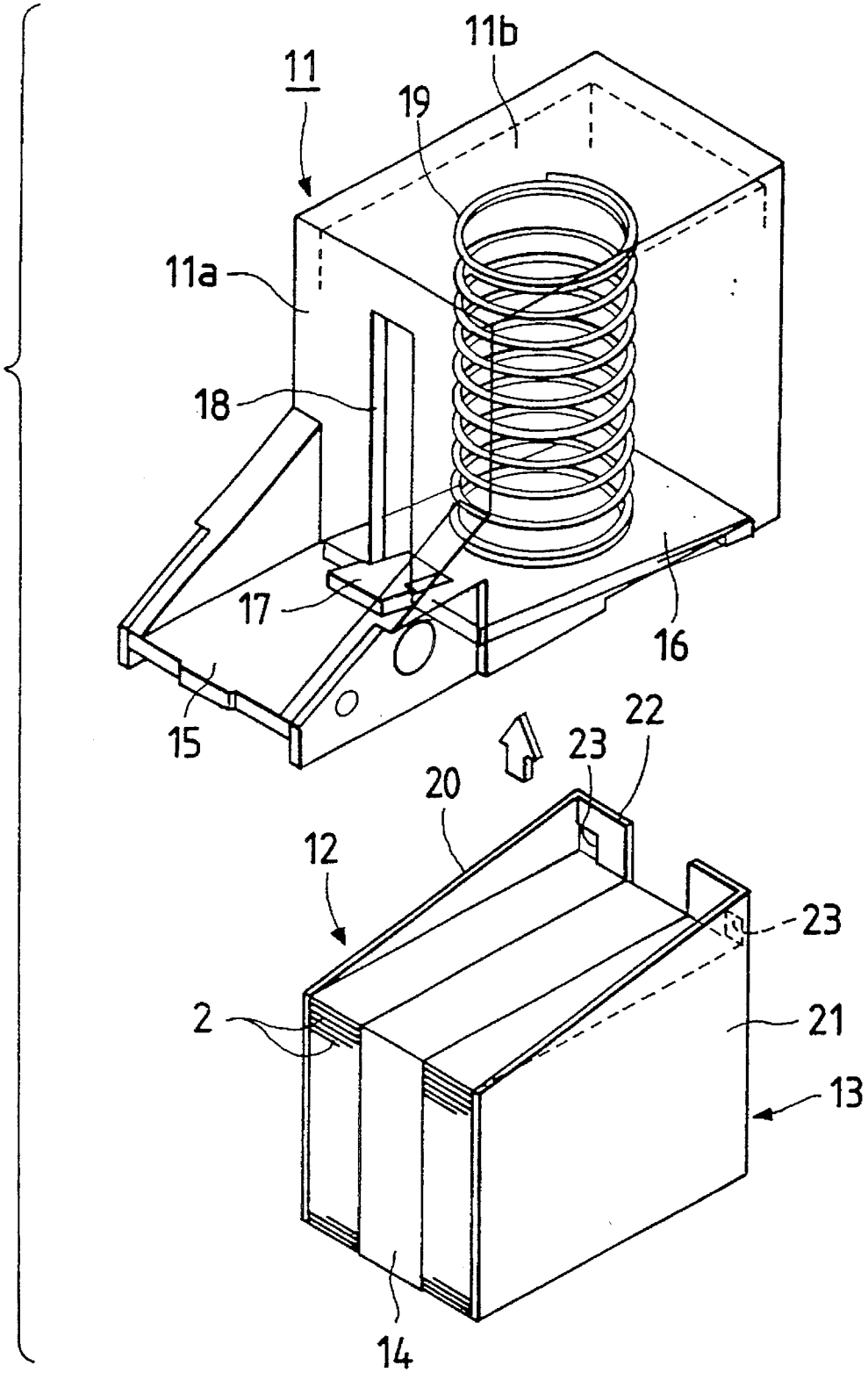
FIG. 1 is a perspective view of a staple cartridge and a staple sheet pack constructed according to a first embodiment of the present invention.

First, a staple cartridge constructed according to a first embodiment of the present invention will be described below with reference to FIGS. 1 to 4. FIG. 1 shows a staple cartridge 11 and a staple sheet pack 12. The staple sheet pack 12 is constructed such that a predetermined number of staple sheets 2 are received in a staple sheet holder 13 in the laminated state while the staple sheets 2 are bundled together with a band 14.

The staple cartridge 11 is designed in a substantially box-shaped configuration having a partially open bottom. A guide plate 15 projects forward from the lower end of the front panel 11*a* of the staple cartridge 11. A press plate 16 is received in a housing of the staple cartridge 11, and a T-shaped protuberance 17 attached to the front end of the press plate 16 extends through a vertically extending elongated slot 18 formed through the front panel 11*a* of the staple cartridge 11 so as not to allow disengagement of the press plate 16 from the staple cartridge 11. A compression coil spring 19 is interposed between the press plate 16 and a ceiling place 11*b* of the staple cartridge 11 so that the press plate 16 is normally biased in the downward direction by the resilient force of the compression coil spring 19.

The staple holder 13 is made of cardboard or a synthetic resin which can be disposed of by burning without causing significant pollution. The upper and lower surfaces and the front surface of the staple holder 13 are at least partially open. The staple holder 13 includes left and right side plates 20 and 21 having upper edges that respectively taper from the rear surface toward the front surface of the staple holder 13 (i.e., from right to left in FIG. 1). In addition, the staple holder 13 includes a rear plate 22 having a height greater than the collective height of the laminated plurality of staple sheets 2. Two engagement holes 23 for receiving a lock lever (described later) are formed through the rear plate 22 at a height that is higher than the uppermost staple sheet of the staple sheet pack 12.

Figure 2A:
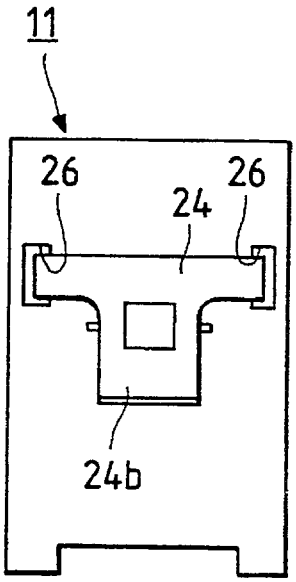
FIG. 2 shows a staple cartridge according to a first embodiment of the present invention wherein FIG. 2(*a*) is a rear view of the staple cartridge and FIG. 2(*b*) is a sectional side view, the same.
Figure 2B:
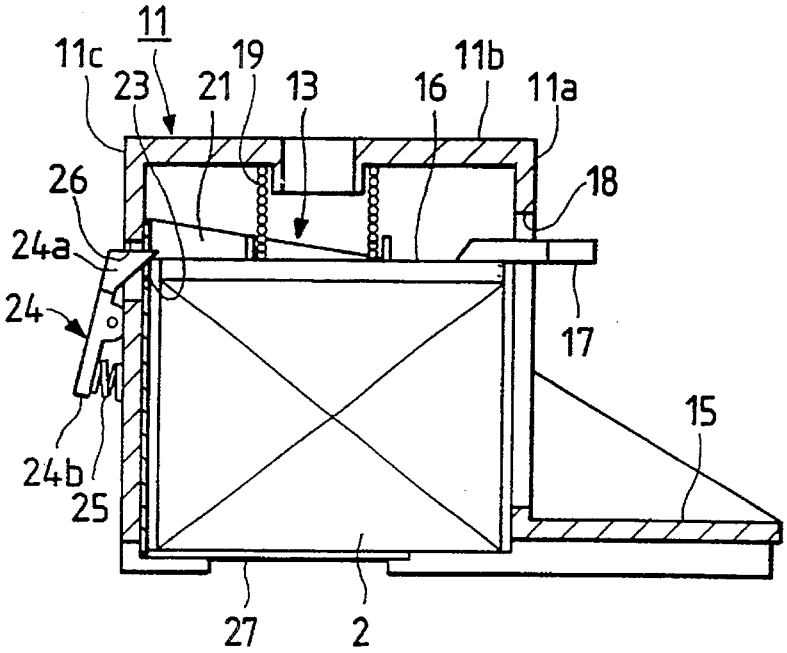
Figure 3:
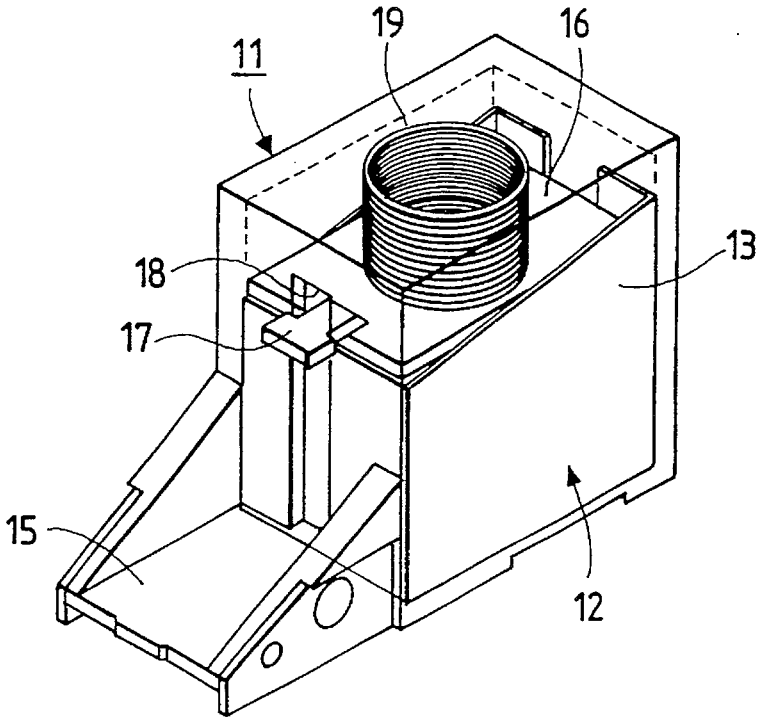
FIG. 3 is a perspective view of a staple cartridge having a staple sheet pack charged therein according to a first embodiment of the present invention.

As shown in FIGS. 2(*a*) and 2(*b*), a locking mechanism for the staple cartridge 11 and the staple holder 13 includes two engagement holes 23 formed through the rear plate 22 of the staple holder 13 and a lock lever 24 turnably disposed on a rear surface portion 11*c* of the staple cartridge 11. A compression coil spring 25 is interposed between the lock lever 24 and the rear surface portion 11*c* of the staple cartridge 11 so that the lock lever 24 is normally turnably biased by the resilient force of the compression spring 25. A pair of engagement pawls 24*a* of the lock lever 24 bifurcated at the front end of the lock lever 24 can be inserted into windows 26 formed through the rear surface portion 11*c* of the staple cartridge 11. When the staple sheet holder 13 (as separately shown in FIG. 1) is inserted into the staple cartridge 11, the rear surface portion 11*c* thereof thrusts the engagement pawls 24*a* of the lock lever 24 so that the pawls 24*a* contact the rear surface plate 22 of the staple sheet holder 13. When the staple sheet holder 13 is further inserted into the staple cartridge 11 to reach an operative position, the engagement pawls 24*a* of the lock lever 24 are fitted into the engagement holes 23 formed through the rear plate 22, whereby the staple sheet holder 13 is firmly held in the staple cartridge 11 in the locked state as shown in FIGS. 2 and 3.

When the staple sheet holder 13 is withdrawn from the staple cartridge 11, a lower end part 24*b* of the lock lever 24 shown in FIG. 2 is depressed until the engagement pawls 24*a* disengage from the engagement holes 23. 0n completion of the depressing operation, the staple sheet holder 13 can be withdrawn from the staple cartridge 11.

When all the staples 1 received in the staple cartridge 11 are consumed, the staple cartridge 11 is disconnected from a motor driven stapler (not shown). Thereafter, the staple sheet holder 13 is withdrawn from the staple cartridge 11 in the above-mentioned manner. Subsequently, a new staple pack 12 is supplied to the staple cartridge 11 while a plurality of staple sheets 2 are bundled together using a band 14 as shown in FIG. 1. The staple pack 12 can then be fitted into the staple cartridge 11. On the other hand, the used staple sheet holder 13 is disposably treated as burnable waste.

Figure 4:
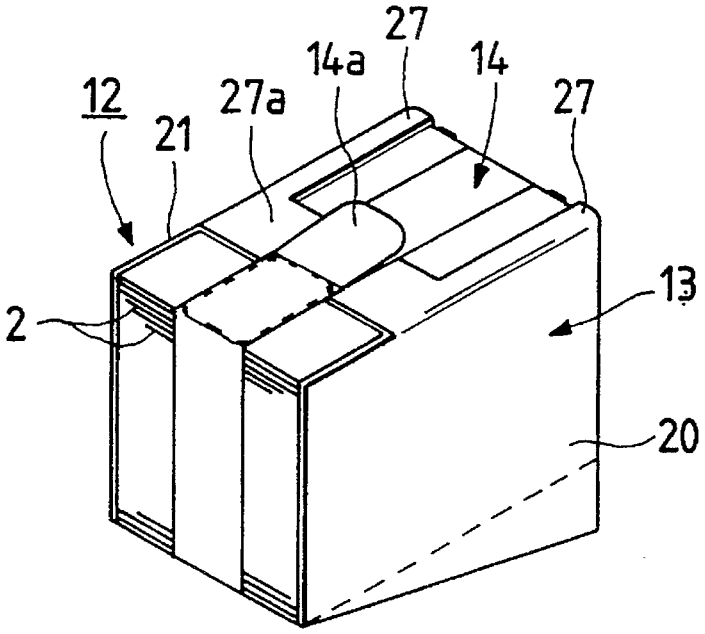
FIG. 4 is a perspective view of a staple sheet pack according to a first embodiment of the present invention, particularly showing the bottom surface of the staple sheet pack.

FIG. 4 shows the bottom surface of the staple sheet pack 12 particularly employable for a roller driving type motor driven stapler. The staple sheet holder 13 includes two bottom plates 27 for supporting a plurality of staple sheets 2 received therein in the laminated state. The bottom plates 27 extend at a right angle from the rear portions of the left and right side plates 20 and 21 at the lower ends thereof. Both bottom plates 27 are connected to each other via joint portions 27*a* located at the intermediate position of the staple holder 13 in the longitudinal direction. The band 14 for bundling the plurality of staple sheets 2 and the staple holder 13 together is prepared in the form of a tape made of paper, polyethylene resin, or the like. In practical use, the opposite ends of the band 14 are overlapped and the band 12 is adhesively secured at the bottom surface of the staple sheet holder 13. An end portion of the band 14 that is not coated with adhesive forms a tab 14*a* , which is later used as pulling means for disconnecting or breaking the band. When the tab 14*a* is pulled after the staple sheet pack 12 is charged in the staple cartridge 11, the adhesively connected part of the band 14 is broken, allowing the band 14 to be withdrawn from the staple sheet pack 12, whereby the front end portion and the rear end portion of the bottom surface of each staple sheet 2 are exposed. While the foregoing state is maintained, driving rollers of the roller driving type motor driven stapler are brought in contact with the staple sheet 2 located at the lowest position of the laminated structure. Subsequently, the staple sheet 2 is conveyed in the forward direction as a motor (not shown) is rotationally driven.

Figure 5:
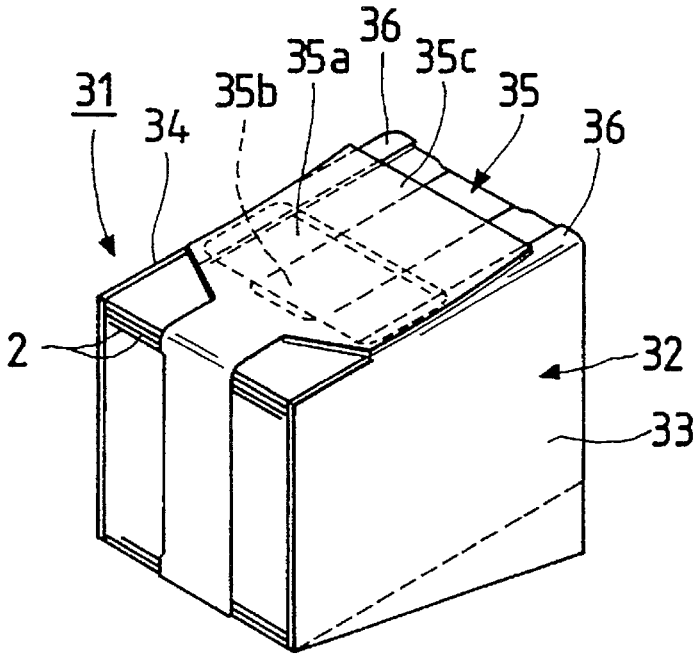
FIG. 5 is a perspective view of a staple sheet pack constructed according to a second embodiment of the present invention, particularly showing the bottom surface of the staple sheet pack.
Figure 19:
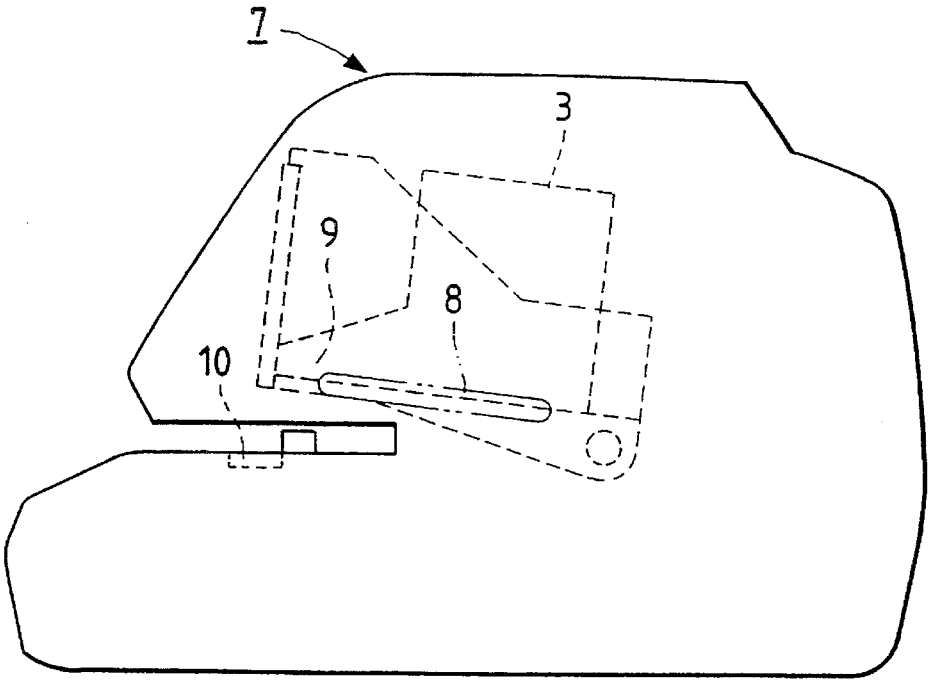
FIG. 19 PRIOR ART
FIG. 19 is an illustrative view which shows the state that a motor driven stapler is charged with a staple cartridge.

FIG. 5 shows a perspective view of a staple sheet pack 31 for a belt driving type motor driven stapler constructed according to a second embodiment of the present invention. A staple holder 32 of the staple sheet pack 31 includes left and right side plates 33 and 34 which are not connected to each other via a bottom surface thereof. Thus, when a band 35 is disconnected from the staple pack 31, the bottom surface of a lowest staple sheet 2 is exposed exclusive of a part thereof supported by the left and right side plates 33 and 34. When a timing belt 8 as shown in FIG. 19 is brought in contact with the staple sheet 2, the staple sheet 2 is conveyed in the forward direction as the timing belt 8 is recirculatively driven. Since the left and right side plates 33 and 34 are not connected to each other via the bottom surface of the staple sheet pack 31, there is a possibility that the left and right side plates 33 and 34 will be displaced in the sideward direction during the bundling process as shown in FIG. 4. To address this problem, one end part 35*a* of band 35 extends in the sideward directions to have a width substantially equal to that of the staple sheet holder 32. The extended part 35*a* of the band 35 is adhesively connected to three locations of the staple sheet pack 31 (i.e., left and right bottom plates 36 and other end part 35*b* of the band 35). Accordingly, a plurality of laminated staple sheets 2 held in the staple sheet pack 31 are bundled together using the band 35 while the side surface plates 33 and 34 are connected to each other via the extended part 35*a* of the band 35. A tab 35*c* is provided as pulling means for the purpose of disconnecting or breaking the band.

The configuration of the staple cartridge 11 is not limited to the preceding embodiments, but may be changed or modified to conform with the specifications of the particular motor driven stapler. It should of course be understood that such changes and modifications fall within the scope of the present invention.

The staple cartridge according to the present invention can repeatedly be used by exchanging the empty staple sheet pack with a new one. Only the used staple sheet holder is disposed of. Thus, public pollution problems that occur due to disposable thermal treatment of the waste material are reduced. Moreover, valuable resources are not needlessly consumed. In addition, employment of the staple cartridge of the present invention is advantageous because the burden of maintaining the staple cartridge in the operative state is reduced.

Furthermore, since the staple sheet pack according to the present invention exhibits excellent handling properties, it can very easily be exchanged in the staple cartridge for empty staple sheet packs.

Figure 6:
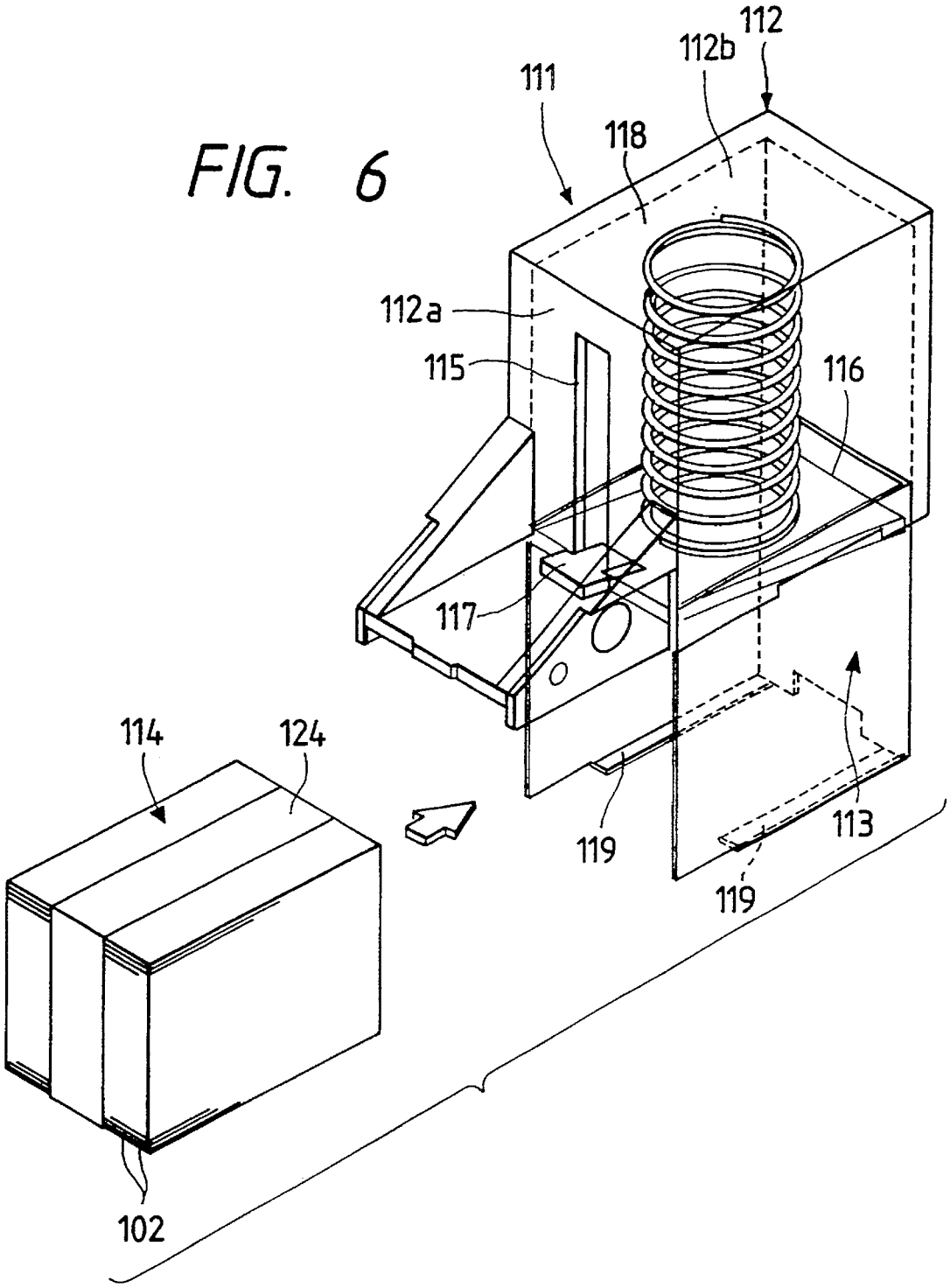
FIG. 6 is a perspective view of a staple cartridge and a staple sheet pack constructed according a third embodiment of the present invention.

A staple cartridge constructed according to a third embodiment of the present invention will be described below with reference to FIGS. 6 to 9. FIG. 6 shows a perspective view of the structure of a staple cartridge 111. FIG. 6 shows a cartridge 112 that serves as a housing, a staple sheet holder 113, and a staple sheet pack 114 in which a plurality of staple sheets 102 in the laminated state are preliminarily received. The cartridge 112 is molded of a transparent synthetic resin to form an integral structure having an open lower surface so that the staple holder 113 can be withdrawn downward below the cartridge 112. A vertically-extending elongated slot 115 is formed through a front panel 112*a* of the cartridge 112. A protuberance 117 is formed at the front end of a press plate 116, which is adapted to be vertically displaced in the cartridge 112 while the protuberance 117 is slidably received in the elongated slot 115. A compression coil spring 118 is interposed between the press plate 116 and a ceiling plate 112*b* of the cartridge 112 so as to allow the press plate 116 to be normally biased in the downward direction by the resilient force of the compression coil spring 118.

Figure 7A:
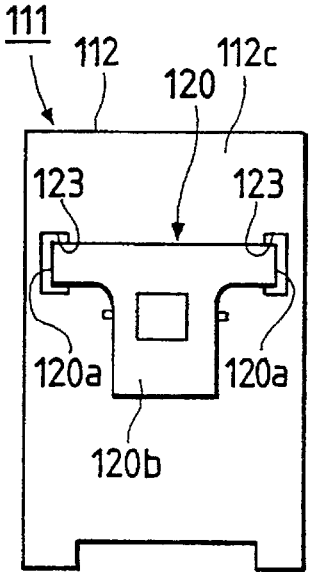
FIG. 7 shows the structure of a staple cartridge according to a third embodiment of the present invention wherein FIG. 7(*a*) is a rear view of the staple cartridge and FIG. 7 (*b*) is a sectional view of the same showing essential components constituting the staple cartridge.
Figure 7B:
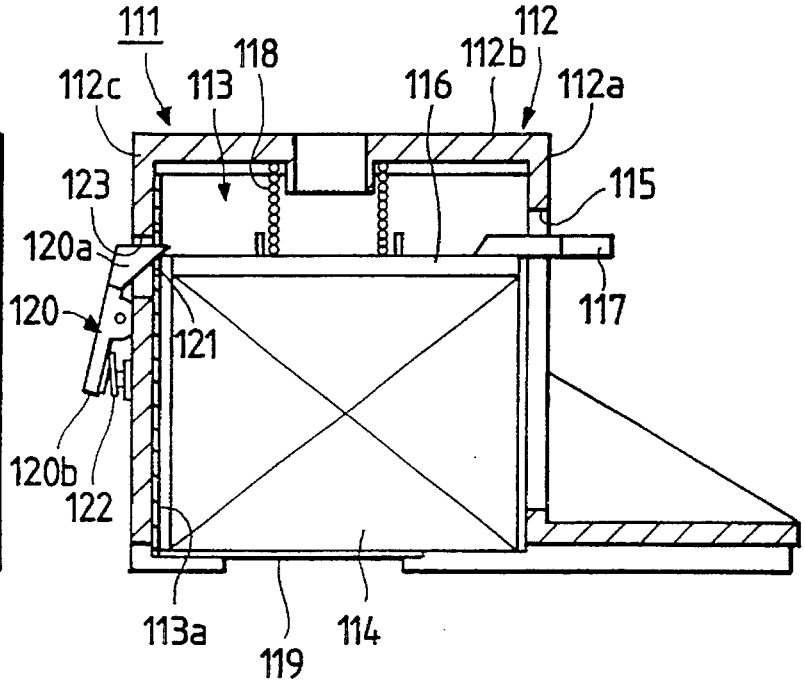
Figure 8:
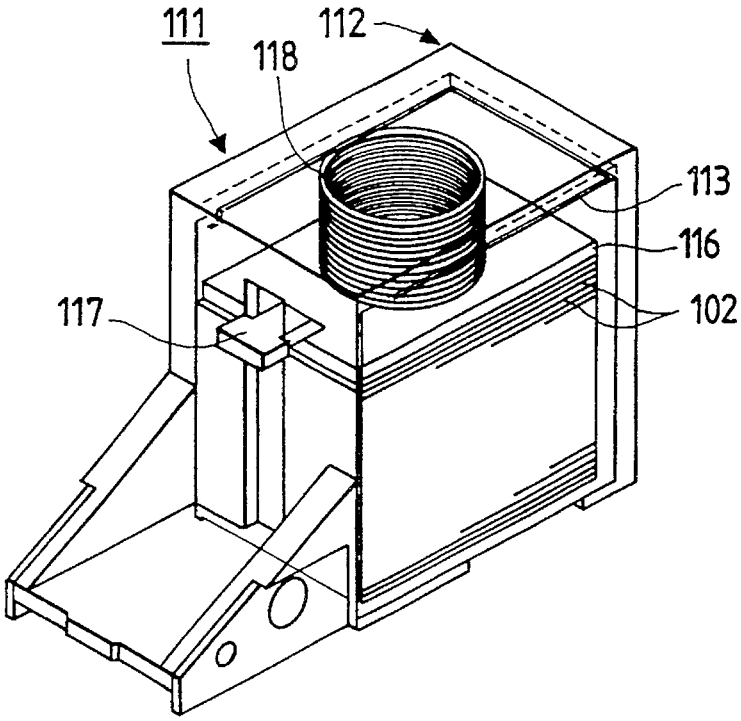
FIG. 8 is a perspective view of a cartridge according to a third embodiment of the present invention, particularly showing the operative state in which a plurality of staple sheets are charged in a staple sheet holder in the laminated state.

As shown in FIG. 6, upper, lower, and front surfaces of the staple sheet holder 113 are at least partially open. Bottom plates 119 are disposed at a right angle along the lower edges of left and right side walls (unnumbered) for supporting a lowest staple sheet in the forward/rearward direction. As shown in FIG. 7, a locking mechanism for the staple sheet holder 113 includes a lock lever 120 turnably disposed on a rear surface portion 112*c* of the cartridge 112 and two engagement holes 121 formed through a rear surface portion 113*a* of the staple sheet holder 113. A compression coil spring 122 is disposed between the lock lever 120 and the rear surface portion 112*c* of the cartridge 112. Two engagement pawls 120*a* of the lock lever 120 bifurcated at the front end of the lock lever 120 are normally biased in the forward direction by the resilient force of the compression coil spring 122, thereby promoting the insertion of the engagement pawls 120*a* into two windows 123 formed through the rear surface portion 112*c* of the cartridge 112. As the staple sheet holder 113 is slidably displaced in the upward direction, the rear surface portion 113*a* of the staple sheet holder 113 thrusts the engagement pawls 120*a* of the lock lever 120 so that the pawls 120*a* contact the rear surface portion 113*a* of the staple sheet holder 113. Subsequently, when the staple sheet holder 113 is inserted into the cartridge 112 to reach an operative position, the engagement pawls 120*a* of the lock lever 120 are fitted into engagement holes 121 formed through the rear surface portion 113c of the staple sheet holder 113. The staple sheet holder 113 is thereby firmly held in the cartridge 112 in the locked state.

When the staple sheet holder 113 is withdrawn from the cartridge 112, a lower end part 120*b* of the lock lever 120 is depressed until the engagement pawls 120*a* of the lock lever 120 disengage from the engagement holes 121. The staple sheet holder 113 can then be withdrawn from the cartridge 112.

Figure 9:
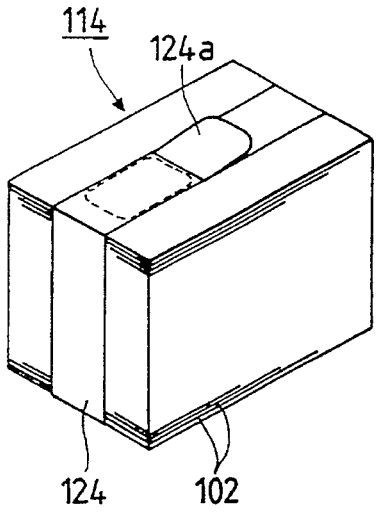
FIG. 9 is a perspective view of the staple sheet pack shown in FIG. 6, particularly showing the bottom surface of the staple sheet pack.

When all the staples received in the staple cartridge 111 are consumed, the staple cartridge 111 is disconnected from a motor driven stapler (not shown). Thereafter, the staple sheet holder 113 is withdrawn from the staple cartridge 111 by practicing the aforementioned steps. As a staple sheet pack 114 is conveyed in the arrow-marked direction while it is held in the bundled state using a band 124, it is inserted into the staple sheet holder 113 through an open portion at the front surface thereof. The band 124 is prepared in the form of a tape made of paper, a polyethylene resin, or the like. The opposite ends of the band 124 are overlapped and the band 124 is adhesively secured at the bottom surface of the staple sheet pack 114 as shown in FIG. 9. An end portion of the band 124 which is not coated with adhesive serves as a tab 124*a* for disconnecting or breaking the band 124.

The staple sheet holder 113 having the staple sheet pack 114 received therein is inserted into in the cartridge 112 until it is firmly locked therein. The tab 124*a* exposed on the bottom surface side is then pulled in the downward direction, causing the band 124 to be broken so as to enable it to be withdrawn from the staple sheet pack 114. At this time, the staple sheet charging operation is complete. In such manner, the staple cartridge 111 can be refilled with a plurality of staple sheet 102 after consumption of all the staples received in the staple cartridge 111.

Figure 10:
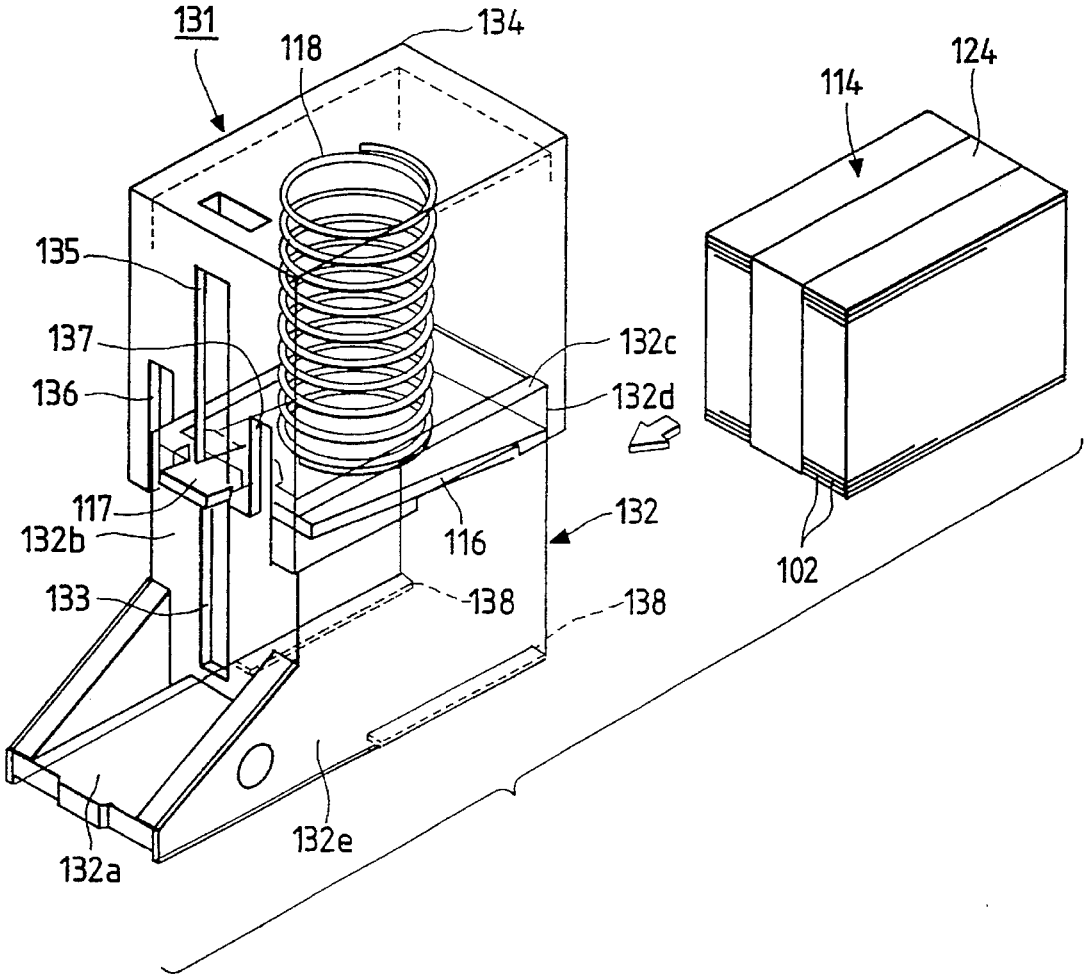
FIG. 10 is a perspective view of a staple cartridge and a staple sheet pack constructed according to a fourth embodiment of the present invention.
Figure 11A:
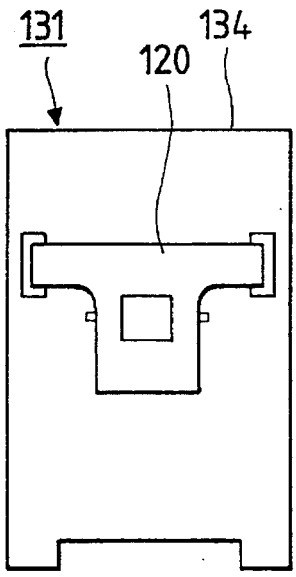
FIG. 11 shows the structure of the staple cartridge shown in FIG. 10 wherein FIG. 11(*a*) is a rear view of the staple cartridge and FIG. 11(*b*) is a sectional view of the same showing essential components constituting the staple cartridge.
Figure 11B:
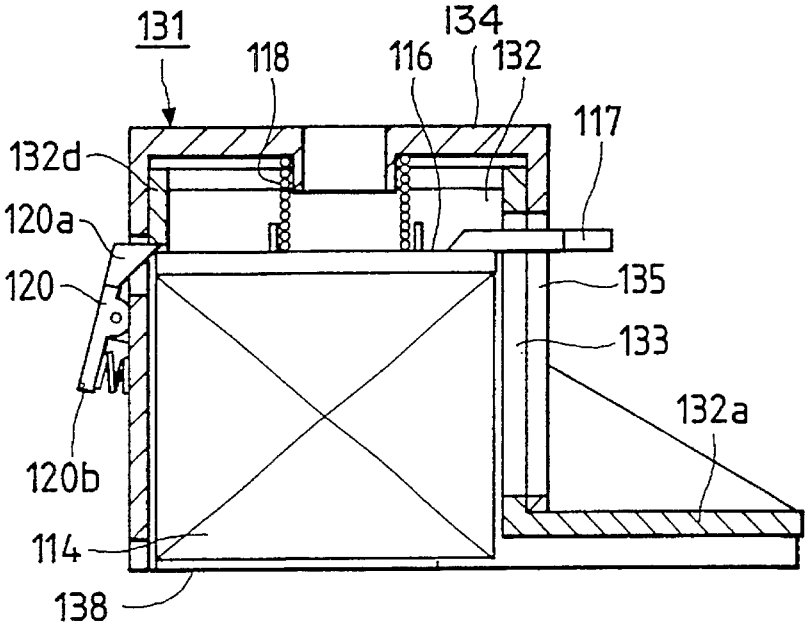

A staple cartridge constructed according to a fourth embodiment of the present invention will be described below with reference to FIGS. 10 and 11. FIG. 10 shows a perspective view of a staple cartridge 131 which includes a housing 134. In contrast with the preceding embodiment, the staple cartridge 131 of the fourth embodiment is constructed such that a staple sheet pack 114 is inserted into a staple sheet holder 132 from the rear side, i.e., in the opposite direction to that of the preceding embodiment. Thus, the rear part of the staple sheet holder 132 is open, and a guide portion 132 is integrated with the staple sheet holder 132 at the front end thereof. A vertically extending elongated slot 133 is formed through a front panel 132*b* of the staple sheet holder 132 so as to allow the vertical displacement of a protuberance 117 of a press plate 116 to be properly guided along the elongated slots 133 and 135. An insert portion for receiving a compression coil spring 118 therein is formed at the central portion of a ceiling plate 132*c*. A rear portion 132*d* of the staple sheet holder 132 extends downward from the rear end of the ceiling plate 132*c*. As shown in FIG. 11, two engagement pawls 120*a* of the lock lever 120 are brought into engagement with the lower edge of the rear portion 132*d*.

To prevent the guide portion 132*a* from interfering with the front surface of the housing 134 when the staple sheet holder 132 is inserted into the housing 134, two elongated slots 136 and 137 are formed through the front surface of the housing 134.

The staple cartridge 131 constructed in the above-described manner can be handled in the same manner as the third embodiment of the present invention with the exception that the staple sheet pack 114 is inserted into the staple sheet holder 132 in the reverse direction. First, the lock lever 120 is depressed in order to unlock the staple sheet holder 132 so that the staple sheet holder 132 can be withdrawn from the housing 134. Subsequently, the staple sheet pack 114 having a plurality of staple sheets in the laminated state received therein is placed on bottom plates 138. The staple sheet holder 132 having the staple sheet pack 114 received therein is inserted into the staple cartridge 131. As shown in FIG. 10, in contrast with the case in which the guide portion 132*a* is formed independently 20 of the staple sheet holder 132, the side surface plates of the staple sheet holder 132 are integrated with the guide portion 132*a* and a stepped part is not formed between the inner surface of the guide portion 132*a* and the inner surfaces of the side surface plates 132*e*. Thus, forward conveyance of each staple sheet 102 from the charged position with the aid of supplying means such as a timing belt 8, rollers (not shown), or the like is not adversely affected by any stepped part formed on the guide portion 132*a*. Accordingly, the staple sheet 102 can smoothly be supplied to the guide portion 132*a*.

With the staple cartridge 111, 131 constructed according to the third and fourth embodiments of the present invention, it is understood that a plurality of unbundled staple sheets 102 (as opposed to the staple sheet pack 114) can be charged in the staple sheet holder 113, 132. In addition, the configuration of the staple cartridge 111, 131 is not limited to that of the aforementioned embodiments of the present invention, but it may be changed or modified depending on the specifications of the particular motor driven stapler. Such changes or modifications fall within the scope of the present invention.

The staple cartridge according to the present intention can be used repeatedly by supplementing staple sheets after consumption of the staples received in the staple cartridge. Since there is no need for disposably treating (i.e., burning) each used staple cartridge, particular problems such as public pollution due to thermal disposable treatment of each used staple cartridge, useless consumption of valuable resources, and the like are avoided. In addition, it is advantageous for each user to employ the staple cartridge of the present invention, since the user is only required to purchase staple sheets to refill the staple cartridge.

With the staple sheet pack according to the present invention, since handling properties of the staple sheet pack can be improved by bundling a plurality of staple sheets to be supplemented to the staple cartridge, the staple sheet charging operation for charging the staple sheet holder with the staple sheets can very easily be achieved.

Figure 12:
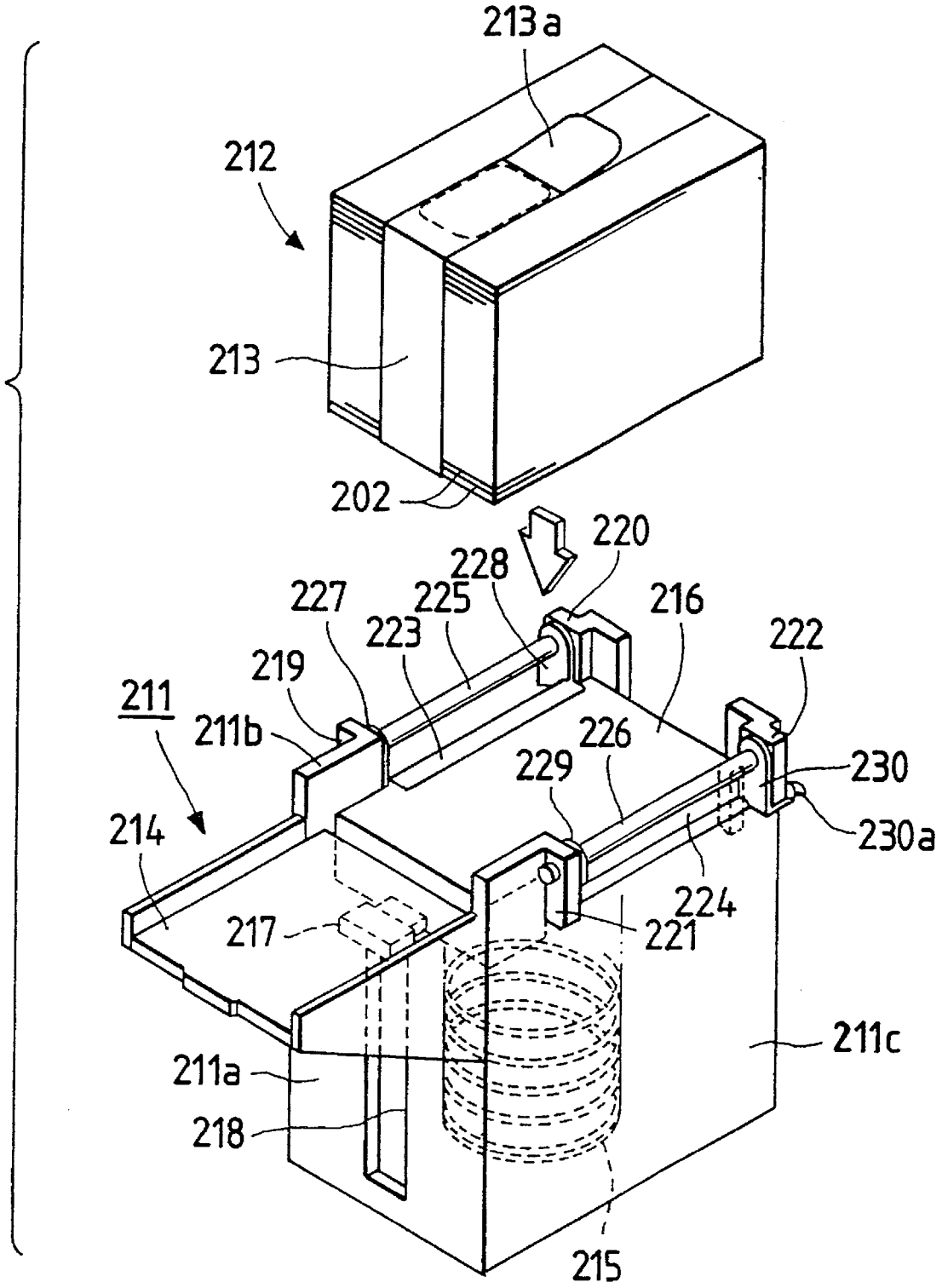
FIG. 12 is a perspective view of a staple cartridge and a staple sheet pack constructed according to a fifth embodiment of the present invention, particularly showing the bottom surface of the staple cartridge and the staple sheet pack.

A staple cartridge constructed according to a fifth embodiment of the present invention will be described below with reference to FIGS. 12 to 15. FIG. 12 is a perspective view of an inverted staple cartridge 211 which shows the bottom surface thereof. As shown in FIG. 12, a staple sheet pack 212 receives a plurality of staple sheets 202 in the laminated state which is bundled together using a band 213. The staple cartridge 211 is molded of a synthetic resin in a substantially box-shaped configuration of which bottom surface (upper surface seen in FIG. 12) is open and a guide portion 214 projects from the lower end of the front surface of the staple cartridge 211. A compression coil spring 215 is interposed between a press plate 216 and a ceiling plate of the staple cartridge 211. A T-shaped protuberance 217 attached to the front end of the press plate 216 is slidably engaged with a vertically extending elongated slot 218 formed through a front panel 211*a* of the staple cartridge 211.

The staple cartridge 211 includes brackets 219, 220, 221, and 222 at the front and rear ends of left and right side plates 211*b* and 211*c* of the staple cartridge 211 on the bottom surface side thereof. Shaft 225 is secured to turnable bottom plate 223 by the brackets 219 and 220; shaft 226 is secured to turnable bottom plate 224 by brackets 221 and 222. Each of the turnable bottom plates 223 and 224 is prepared in the form of a L-shaped plate (i.e., an angle-shaped plate bent at a right angle) and respectively secured to the shafts 225 and 226 via arms 227, 228 and 229, 230.

Figure 13:
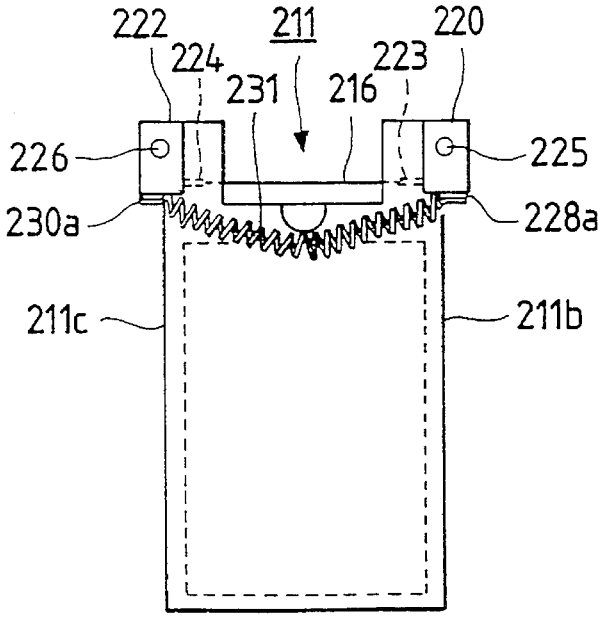
FIG. 13 is a rear view of the staple cartridge shown in FIG. 12.

As shown in FIG. 12, bent portions 228*a* and 230*a* disposed at the ends of the rear arms 228 and 230 are bent in the rearward direction to protrude outward from the rear surface of the staple cartridge 211 and are operatively connected to each other via a tension coil spring 231 resiliently bridged therebetween. With this construction, the left and right turnable bottom plates 223 and 224 are normally turnably biased in the inward direction relative to the staple cartridge 211. However, since the bent portions 228*a* and 230*a* of the rear arms 228 and 230 contact against the side plates 211*b* and 211*c* in the course of the turnable displacement of the turnable bottom plates 223 and 224, they are not permitted to be turnably displaced further. Thus, as shown in FIG. 13, the turnable bottom plates 223 and 224 are secured in such a manner as to enclose a part of the open bottom surface of the staple cartridge 211. In addition, as shown in FIG. 14(*a*), the press plate 216 is positioned at the substantially same height as the tunable bottom plates 223 and 224 by the restrictive function derived from the engagement of the protuberance 217 with the rectangular elongated slot 216.

Next, a method of charging the staple cartridge 211 with a plurality of staple sheets 202 and the operative movement of the turnable bottom plates 223 and 224 are described below.

Figures 14A, 14B, 14C:
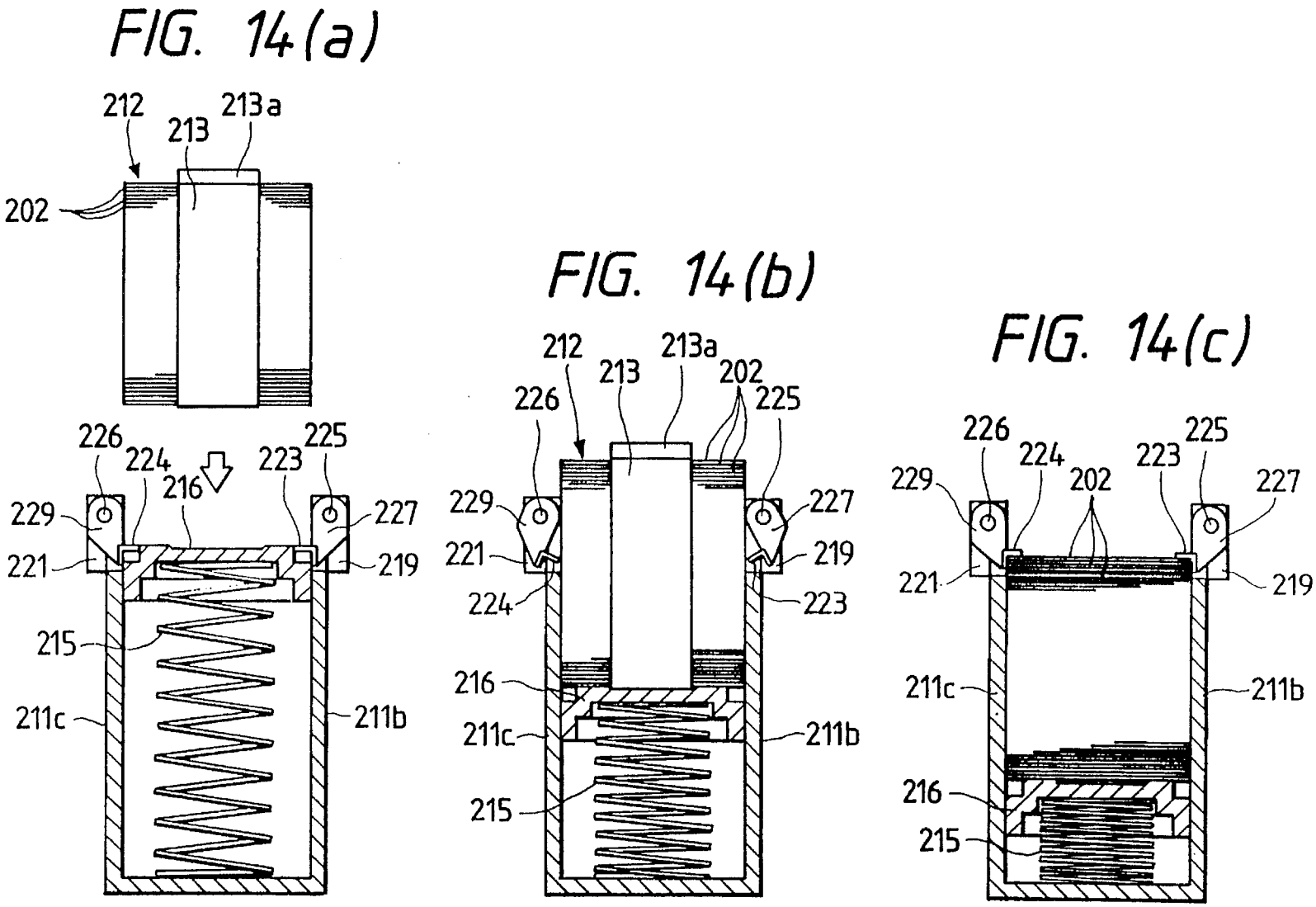
FIG. 14 shows a staple cartridge and a staple sheet pack according to a fifth embodiment of the present invention, wherein FIG. 14(*a*), FIG. 14(*b*) and FIG. 14(*c*) show a procedure for charging the Staple sheet pack in the staple cartridge, respectively.

As shown in FIG. 14(*a*), the staple cartridge 211 is inverted and a staple pack 212 is inserted into the staple cartridge 211 through the open portion formed through the bottom surface of the staple cartridge 211. The staple pack 212 is inserted so that tab 213*a* projecting from band 213, which extends around the staple sheet pack 212, is located on the bottom surface (i.e., upper portion of FIG. 12) of the staple sheet pack 212.

As shown in FIG. 14(*b*), as the staple sheet pack 212 is inserted into the staple cartridge 211, the press plate 216 is forcibly lowered. The turnable bottom plates 223 and 224 are thereby subjected to a downward load, causing the plates 223 and 224 to turn about their respective shafts 225 and 226 in the outward direction. The staple sheet pack 212 is further displaced in the downward direction while coming in slidable contact with the inner edges of the turnable bottom plates 223 and 224. When the upper end of the staple sheet pack 212 is displaced below the inner edges of the turnable bottom plates 223 and 224, the turnable bottom plates 223 and 224 are restored to their original positions by the resilient force of the tension coil spring 231. After the turnable bottom plates 223 and 224 are restored to the original positions, the downward directed load is removed from the staple sheet pack 212 and the staple sheet pack 212 is raised by the compression coil spring 215 and the press plate 216 until it contacts the lower surfaces of the turnable bottom plates 223 and 224. The staple sheet pack 212 is thereby secured in the staple cartridge 211.

Figure 18:
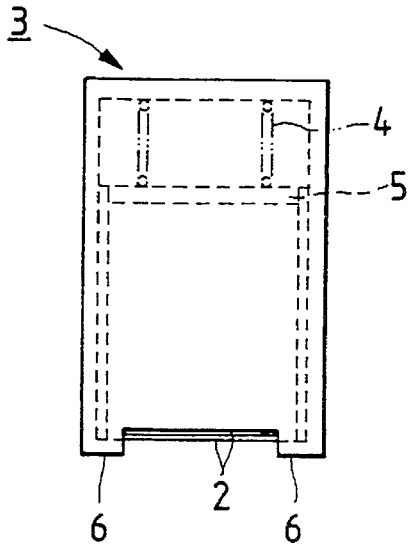
FIG. 18 PRIOR ART
FIG. 18 is a rear view of the conventional staple cartridge.

After the staple sheet pack 212 is charged into the staple cartridge 211, the band 213 is disconnected from the staple sheet pack 212 by pulling the tab 213*a* in the upward direction as shown in FIG. 14(*b*). The staple sheet pack 212 is then ready to be used, as shown in FIG. 14(*c*). subsequently, it is charged in the motor driven stapler in the same manner as mentioned above with reference to FIG. 18.

Figure 15:
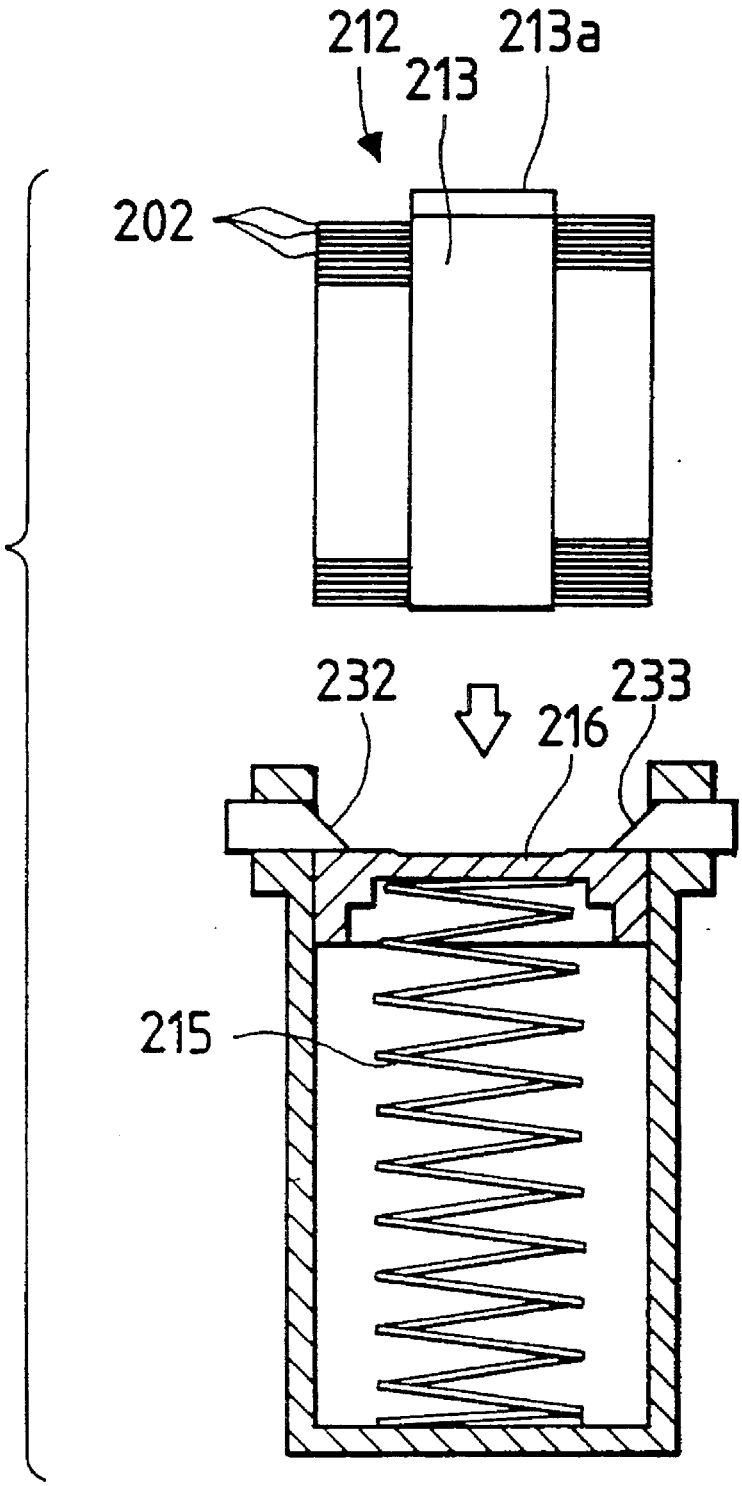
FIG. 15 is a sectional view of a staple cartridge and a staple pack constructed according to another embodiment of the present invention, particularly showing bottom plates adapted to be slidably displaced in the leftward/rightward direction.
Figure 16A:
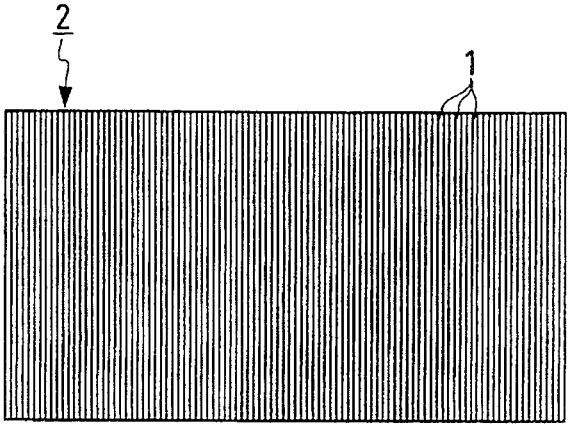
FIG. 16(a) PRIOR ART
FIG. 16 shows a staple sheet wherein FIG. 16(*a*) is a plan view of the staple sheet, FIG. 16 (*b*) is a front view of the same, and FIG. 6(*c*) is a side view of the same.
Figure 16B:
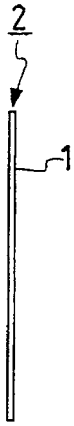
FIG. 16(b) PRIOR ART
Figure 16C:
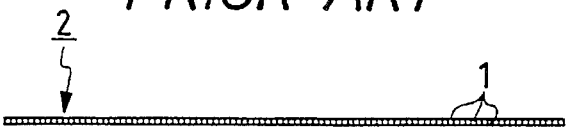
FIG. 16(c) PRIOR ART
Figure 17:
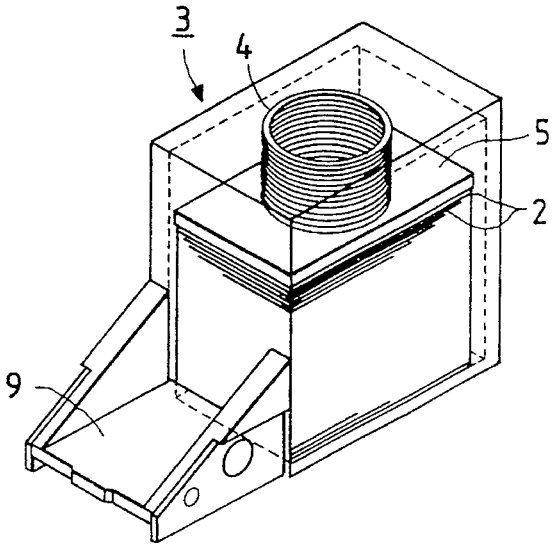
FIG. 17 PRIOR ART
FIG. 17 is a perspective view of a conventional staple cartridge.

The structure of the opening/closing mechanism for opening or closing the turnable bottom plates 223 and 224 should not be limited to the exemplary turnable type mentioned above. For example, FIG. 15 shows an alternative staple cartridge and staple sheet pack constructed according to a sixth embodiment of the present invention. The opening/closing mechanism may be modified to allow the bottom plates 232 and 233 to be slidably displaced in the leftward/rightward direction until they are displaced into an open position. In addition, a staple sheet pack 212 to be charged in the staple cartridge 211 is not limited to a type which is bundled by using a band extending therearound. For example, a plurality of unbundled staple sheets 202 in the laminated state may be charged in the staple cartridge 11.

As is apparent from the above description, according to the present invention the staple cartridge can be repeatedly and extensively used by supplementing the staple cartridge with a plurality of staple sheets after consumption of the staples received in the staple cartridge. In contrast with the conventional disposable type staple cartridge, particular problems such as public pollution induced by thermal disposal treatment of used staple cartridges, useless consumption of a valuable resources, and the like are avoided by the present invention. In addition, employment of the staple cartridge of the present invention is economically advantageous since only staple sheets (and not new staple cartridges) need be purchase by the user.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A staple cartridge for a motor driven stapler comprising:

a receiving means for receiving a plurality of staple sheets having a laminated structure bundled by a band member, each staple sheet including a plurality of straight staples successively connected to each other in a side-by-side relationship, said receiving means comprising:
a base member; and
a staple holder means movable relative to said base member for holding said staple sheets;

a spring means for biasing said staple sheets inserted into said receiving means, said staple sheets being biased in a downward direction with respect to said cartridge; and a first locking means for locking said staple sheets, biased by said spring means, at a predetermined position in said staple cartridge, wherein said staple cartridge is detached from said motor driven stapler when said staple sheets are inserted into said receiving means; and wherein said staple holder means has at least one engagement hole for receiving said first locking means.

2. A staple cartridge according to claim 1, wherein said staple holder means is detachably fitted into said base member.

3. A staple cartridge according to claim 2, wherein said staple holder means is made of a material which is suitable for disposal as a burnable waste material without causing significant pollution.

4. A staple cartridge according to claim 2, wherein said staple holder means includes left and right side plates and a rear plate, said rear plate having said at least one engagement hole therein.

5. A staple cartridge according to claim 1, wherein said staple holder means is slidable relative to said base member for providing an opening through which said staple sheets are inserted into said receiving means.

6. A staple cartridge according to claim 1, further comprising a second locking means which comprises:

bottom plates for supporting said bundled staple sheets inserted into said receiving means; and an opening/closing mechanism for opening and closing said bottom plates so that said staple sheets are charged in said receiving means through an open portion formed at a bottom of said receiving means.

7. A staple cartridge according to claim 6, further comprising:

a spring means for maintaining said bottom plates in a closed position after insertion of said staple sheets.

8. A staple cartridge according to claim 1, wherein said base member comprises:

a front left bracket, a front right bracket, a rear left bracket, and a rear right bracket;

a left shaft having a longitudinal axis and secured between said front left bracket and said rear left bracket; and a right shaft having a longitudinal axis and secured between said front right bracket and said rear right bracket;

said staple cartridge further comprising a second locking means which comprises:
a left bottom plate that rotates about said longitudinal axis of said left shaft, and
a right bottom plate that rotates about said longitudinal axis of said right shaft, wherein said left and right bottom plates collectively support said staple sheets inserted into said receiving means.

9. A staple cartridge according to claim 8, wherein said second locking means further comprises:

a front left arm and rear left arm for collectively securing said left shaft and for positioning said left bottom plate in a closed position after insertion of said staple sheets; and a front right arm and rear right arm for collectively securing said right shaft and for positioning said right bottom plate in a closed position after insertion of said staple sheets.

10. A staple cartridge according to claim 9, wherein said locking means further comprises a spring means for maintaining said bottom plates in a closed position after insertion of said staple sheets.

11. A staple cartridge for a motor driven stapler comprising:

a receiving means for receiving a plurality of staple sheets having a laminated structure, each staple sheet including a plurality of straight staples successively connected to each other in a side-by-side relationship, said receiving means comprising:
a base member which comprises:
a front left bracket, a front right bracket, a rear left bracket, and a rear right bracket;
a left shaft having a longitudinal axis and secured between said front left bracket and said rear left bracket; and
a right shaft having a longitudinal axis and secured between said front right bracket and said rear right bracket; and a staple holder means movable relative to said base member for holding said staple sheets;

a spring meads for biasing said staple sheets inserted into said receiving means, said staple sheets being biased in a downward direction with respect to said cartridge; and a locking means which comprises:

a left bottom plate that rotates about said longitudinal axis of said left shaft, and a right bottom plate that rotates about said longitudinal axis of said right shaft, wherein said left and right bottom plates collectively support said staple sheets inserted into said receiving means.

12. A staple cartridge according to claim 11, wherein said locking means further comprises:

a front left arm and rear left arm for collectively securing said left shaft and for positioning said left bottom plate in a closed position after insertion of said staple sheets; and a front right arm and rear right arm for collectively securing said right shaft and for positioning said right bottom plate in a closed position after insertion of said staple sheets.

13. A staple cartridge according to claim 12, wherein said locking means further comprises a spring means for maintaining said bottom plates in a closed position after insertion of said staple sheets.

* * * * *